United States Patent [19]

Darda

[11] 3,995,906

[45] Dec. 7, 1976

[54] ROCK-SPLITTING APPARATUS

[76] Inventor: Helmut Darda, Im Tal, D-7712 Blumberg, Germany

[22] Filed: June 16, 1975

[21] Appl. No.: 587,384

[52] U.S. Cl. ..... 299/22

[51] Int. Cl.[2] ..... E21C 37/04

[58] Field of Search ..... 299/21–23

[56] References Cited

UNITED STATES PATENTS

| | | | |
|---|---|---|---|
| 2,093,452 | 9/1937 | Joy | 299/22 |
| 3,414,328 | 12/1968 | Darda | 299/22 |
| 3,439,954 | 4/1969 | Darda | 299/22 |

*Primary Examiner*—Ernest R. Purser
*Attorney, Agent, or Firm*—Haseltine, Lake & Waters

[57] ABSTRACT

A rock-splitting apparatus consists of a cylindrical block, in which a hydraulically actuatable piston is disposed to move in a longitudinal direction. The piston acts by way of a slider wedge which is connected to the rod of the piston on presser cheeks which can be inserted into drill holes and which have an obliquity which is complementary to that of the slider wedge, in which the presser cheeks are suspended from transverse pins by way of heads of these cheeks, so as to be axially fixed in position and capable of restricted lateral movement. That movement corresponds to the variation in width of the axially movable slider wedge; the piston rod is sealingly guided by a guide sleeve which is connected in an oil-tight manner with a casing.

21 Claims, 11 Drawing Figures

156
162
158
152
163
114
160
150
116
172
V
V
117
113
110
126
122
112
124
128
174
132
136
130
134

150
172
110

174

164
117
166
122
168
170
VII
VII
128
136
132

258
256
252
263
214
260
250
262
IX
IX
272
216
213
210
217
212
226
222
228
274
232
224
236
234
230

272
252
210

274
228
228

264
226
266
270
228
XI
XI
236
232

ROCK-SPLITTING APPARATUS

The present invention relates to a rock-splitting apparatus.

A rock-splitting apparatus of the above-mentioned type is disclosed in U.S. Pat. No. 3,414,328 and, by means of a thruster wedge, enables the rock to be treated to be effectively mechanically broken up. The apparatus consists of a hollow cylindrical part, in whose open end a guide sleeve is screwed, so as to delimit the cylindrical space partially as far as a stop member. The guide sleeve enables the piston rod to be guided in tight-sealed manner, the thruster wedge being screwed, at the end lying remote from the piston, into the end of the piston rod. Two diametrically opposite-lying transverse pins pass through the guide seleeve at the outer or lower portion thereof, these transverse pins bearing, inwardly and subject to spring pressure, against the thruster wedge, which is formed with parallel walls in this region, whereby the thruster wedge is guided. The tapering part of the thruster wedge lies outside the guide sleeve and is surrounded by the presser cheeks, which are shiftable to some extent laterally and each of which partially engages round a respective one of the transverse pins, whereby the longitudinal position of the pressure cheeks is fixed. Although the above-described apparatus is excellent for the purpose intended for it, it is of relatively complicated construction, and requires relatively thick-walled guide and cylinder-parts, which have to be permanently and securely screwed together. Moreover, owing to the fact that it is dished in construction, the cylindrical part can only be manufactured with considerable expenditure in raw material. Furthermore, as the transverse pins abut against the straight part of the thruster wedge, tapered thruster or pull-wedges cannot be used over substantially the whole of their length. Apart from this limitation, there is the result of an increased effective (structural) length of the apparatus. These and other drawbacks prevent utilisation as an economical and maximally simply constructed, very flexible rock-splitting apparatus.

The same is true of a rock-splitting application disclosed in U.S. Pat. No. 2,093,452. Although this known equipment entails a very complicated mode of suspension of the presser cheeks from the cylinder, serious mechanical weaknesses are inherent in the equipment and risk rupturing of the suspension means in the course of the rock-splitting operations. This equipment, too, which is in some respect improved by the equipment disclosed in U.S. Pat. No. 3,414,328 does not commend itself as an economical, simple and versatile rock-splitting equipment.

In the case of a rock-splitting equipment, which is also hydraulically actuated and is disclosed in U.S. Pat. No. 3,414,328 the cylindrical part and the guide sleeve are subject to the same drawbacks as the equipment disclosed in U.S. Pat. No. 2,093,452, and the heads of the presser cheeks are supported, through the intermediary of shoulders, on thruster discs and annular supports, which have to be inserted within the apparatus and adjusted in their position. A shoulder suspension of this kind is relatively complicated, and does not permit a simple assembly or dismantling of the apparatus.

Accordingly, underlying the present invention is the object of providing a rock-splitting apparatus of the above-defined type, which is of maximally simple and economic construction, while at the same time the above-mentioned drawbacks are eliminated, the proposed apparatus being susceptible of very easy assembly and disassembly, while at the same time it is very reliable in operation, utilises a very effective form of suspension for the presser cheeks, and is more versatile in its possible practical applications.

It is proposed, for realising the above-stated object and in the context of a rock-splitting apparatus of the above-defined type, that the casing and the guide sleeve, which is shorter than the casing, be constructed as cylindrical tubes, one of which can be pushed into the other; and that the casing be closed off, at one end thereof, by means of a cylindrical cover, while two mutually parallel transverse pins of any desired cross-sectional shape pass through the other end of the casing, these transverse pins extending, perpendicularly of the longitudinal direction of the apparatus, on opposite sides of the heads of the presser cheeks and at least partially engaging in lateral recesses of the said heads of the presser cheeks so as to longitudinally locate the presser cheeks. An apparatus of this kind can be very simply constructed from normal tubes, one of which has simply to be pushed into the other. In this way it is possible to effect appreciable saving in raw materials owing to the fact that an integral dished cylinder part is dispensed with, and owing to the fact that these parts do not have to be screwed together (so as to attach them securely to one another), which would require the walling to be made thicker. Furthermore, the insertion, by pushing, of the guide sleeve simplifies the assembly work. Also, due to the fact that the transverse pins are no longer supported from the slider wedge — these transverse pins extending on opposite faces of the slider wedge — it is possible to use slider wedges which are tapered over the greater part of their length. These slider wedges are, in their upper portion, and by reason of the tapers, more stable than parallel-walled slider wedges, and therefore require no further guidance, in contradistinction to the situation in the case of the known apparatus. As the heads of the presser cheeks are suspended from the transverse pins in such a way as to locate the presser cheeks longitudinally, while at the same time they are laterally slidable, it is possible to dispense with the supporting thruster discs and annular supports required in the case of a suspension carried out purely by means of a shoulder. The apparatus according to the invention is, in general, of simpler construction and easier to assemble, so that its manufacturing costs can be lowered without thereby impairing the advantages inherent in its operation.

A particularly practical form of construction consists in arranging for the guide sleeve to be located, by the transverse pins fixed to the casing, axially and circumferentially relative to the casing. Accordingly, additional members for locating the guide sleeve are rendered unnecessary, and the transverse pins fulfil multiple functions, as they constitute axial locating members for the guide sleeve and the presser cheeks and radial guide members for the laterally slidable presser cheeks. It is preferable if the guide sleeve has, at one end, two opposite-lying guide strips, serving as axial extensions of the guide sleeve which at least partially surround the transverse pins from the outside. Conveniently, the guide strips may be disposed between the heads of the presser cheeks. Thus, the guide sleeve only extends by way of the guide strips in the region of the heads of the presser cheeks, these guide strips extending between the heads of the presser cheeks and engaging round the transverse pins. This results in a very simple form of construction, achieved with only a few parts. While the provision of separate locating members for the guide sleeve is rendered unnecessary, the guide strips, which form a unit with the guide sleeve do not disturb the ability of the presser cheeks to be moved laterally.

The transverse pins are preferably secured in the casing by means of screws. Hence, loosening of the transverse pins, so that the latter can fall out, is reliably prevented even when the apparatus is working in rough conditions; this is essential for satisfactory operation of the equipment. After the screws have been loosened, the transverse pins can be very simply taken out for disassembly purposes. It will be found to be still more satisfactory if the transverse pins are connected together, with their ends lying remote from the screws, by means of a U-shaped pin. This U-shaped pin enables the said transverse pins to be simultaneously pulled out or pushed in by means of a single handle, and also enables the apparatus to be more favourably manipulated, as the U-shaped pin is also usable, in operation, as an additional handle.

Conveniently, the piston may be positioned, in the cylinder space, between the cylindrical cover and the end face of the guide sleeve. The inlet and outlet ducts for the pressurised oil to the upper and lower ends of the cylinder may pass through the cylindrical cover and in the longitudinal direction of the casing, and also may pass trnasversely through the latter. In this case of a particularly simple form of construction, the inlet and outlet ducts for the lower end of the cylinder extend, in the longitudinal direction, outside the casing. This arrangement results in very low manufacturing costs. A somewhat more expensive, although improved form of construction, results if the inlet and outlet ducts for the lower end of the cylinder is longitudinally machined into the casing. If the latter-mentioned modification is adopted, however, the casing should be made thicker in the vicinity of the inlet and outlet duct, so that the casing — its wall is made maximally thin, when the stresses to which this wall is subjected are taken into consideration — will not be weakened to too great an extent in this area.

Disregarding the fact that the rock-splitting apparatus can, in the simplest instance, be operated without an incorporated control valve, it is more satisfactory if the inlet and outlet ducts are led to such a known control valve in the cylinder cover. This control valve should, conveniently, be a four-way valve, so as to enable the oil infeed and oil discharge ducts to be connected — selectively, that is to say with a view to effecting switchover of movements — to the upper and lower ends of the cylinder. It will be particularly satisfactory if the control valve communicates, by way of an annular groove at the circumference of the cylindrical cover screwed into the casing, with a transverse duct in the casing, this transverse duct in its turn leading to the inlet and outlet duct which extends longitudinally in the casing. This arrangment ensures that there will always be — to a large extent independently of the instantaneous rotational position of the cylindrical cover — communication, for the purpose of transfer of pressurised oil, from the control valve (via the duct in the casing) to the lower end or face of the cylinder. Hence, there will not be any problems, in this region, insofar as assembly or positional adjustment are concerned. Furthermore, the means required for achieving this are extemely simple, and merely require drilling to be carried out in the casing and in the cylindrical cover and the provision of an annular groove at the periphery of the cylindrical cover.

According to a further modification of the invention, the guide sleeve has, at the side of the cylinder, a guide sleeve part, whose internal diameter is smaller than the guide sleeve and which seals off the piston rod, the piston rod being guided in the guide sleeve by means of a piston rod part of increased outer diameter and in the form of a guide ring, which is known per se. Through the provision of the known guide ring it is ensured that the piston rod will not come into direct contact with the inner surface of the guide sleeve, and that dirt, entrained into the interior by way of the slider wedge, will not reach the surface of the piston rod, as that could rapidly lead to damage being caused. As the guide part lies on the side lying remote from the dirt side of the guide ring, it can serve, without risk, to give additional guidance to the piston rod. Furthermore, the guide sleeve part acts as a movement-limiting stop means. It will be found convenient, from considerations of assembly and manufacture, if the guide sleeve part and/or the guide ring constitute separate components. The guide sleeve and/or the guide sleeve part may comprise, in a manner known per se, at least one sealing element on the outside and inside, and at least one dirt scraper means on the inside. It is particularly satisfactory if these parts are concentrated on the guide sleeve part so that, if replacement (exchange) should prove necessary, only parts of relatively small material bulk have to be renewed, such renewal being susceptible of taking place simply and rapidly; with this in view only one guide sleeve part has to be introduced, in the present instance, for replacement (exchange) purposes.

Preferably, the piston rod surrounds one end of the slider wedge, i.e. the end by which the latter is attached to the piston rod, and is connected to the slider wedge by way of a pin which is guided through the slider wedge and through the piston rod. Conveniently, this pin should extend approximately transversely of the direction in which the presser cheeks are movable (or spread apart from each other), and allow the slider wedge to be pivotable to some extent relative to the longitudinal direction. Apart from the fact that the pin enables the parts to be rapidly attached to one another and released from one another with simple means, the limited freedom to pivot the slider wedge ensures satisfactory operation even when the presser cheeks are laterally shifted or pivoted in an asymmetrical manner; this is because damage caused to the apparatus through tilting — this damage for example occurring through the piston or the piston rod seizing — is reliably prevented. Also, assembly work is simplified through this slight play permitted.

Preferably, the pin also passes through the guide ring, which has been pushed on to the piston rod. It is satisfactory if the pin has a respective annular groove at each of its ends, one or more retaining springs snap-engaging, from an inner recess of the guide ring, into these annular grooves. In this way this pin serves a multiple purpose, as it locates the slider wedge and also the guide ring on the piston rod. This form of construction is made up of only a few parts, and is also of a very great practical value, because the pin can be secured in position simply by inserting it by a pushing action and, when disassembly is to take place, this pin can be removed by the application of lateral pressure or by knocking it out of position. Conveniently, and with a view to carrying out assembly or disassembly of this kind within the casing, the casing may comprise, at two diametrically opposite points, radially-extending screwthreaded closure members, the diameter of at least one of these screwthreaded closure members being greater than that of the pin. In this way the pin can be introduced — and, accordingly, the required attachment of the parts can be effected — through one of these screwthreaded members, while at any time the pin can be removed by knocking it out from the other side.

With a view to ensuring the longest possible useful working life, it will be found advantageous to provide the slider wedge and/or the presser cheeks with a hard metal facing in the areas of mutual engagement. Further, it is preferable to form the piston and the piston rod as an integral unit, and to equip the piston with piston rings, which are pushed on to the piston, and are secured in position thereon by retaining rings. This results in a very simple form of construction which can be improved upon, above all for the purpose of reducing weight, by arranging for the piston and piston rod to be drilled into from above. Furthermore, the oil passes into the space produced by this drilling action, and fills out this space, ressulting in an increase in stability. Further, the forces to be transmitted in the axial direction are only absorbed to a relatively small extent by the side walls of the hollow space, as the inner, lower, and relatively large transverse surface of the hollow space mainly comes to bear, so that the wall of the piston or piston rod is relieved in comparison with a situation in which the bore is closed off at the open end.

The rock-splitting apparatus proposed according to the invention is in many respects particularly favourable and versatile from the point of view of costs and for practical reasons. It can be used both as an apparatus using a thruster (presser) wedge and also an apparatus using a pull wedge. All individual parts can be assembled together and also dismantled simply and quickly, which is of particular importance for favourable release of the presser cheeks, as the latter have to be replaced at different times for dimensioning reasons, and sometimes owing to their being damaged. As various members have multiple purposes, the number of components required can be reduced, and manufacturing costs also reduced, while assembly is rendered simpler.

Embodiments of the invention are hereinafter described, by way of example, with reference to the accompanying drawings, in which.

Figure 1:
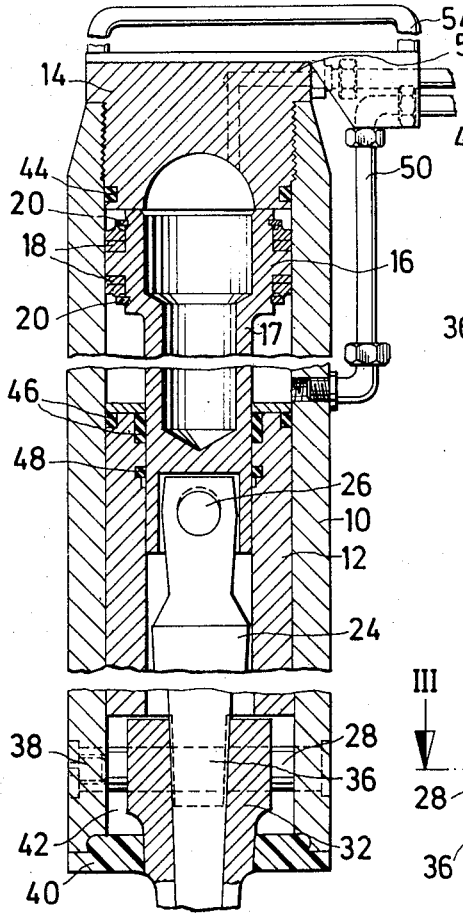
FIG. 1 is a sectional elevation of a particularly simple rock-splitting apparatus, the apparatus having a thruster wedge which is shown in the retracted position.
Figure 3:
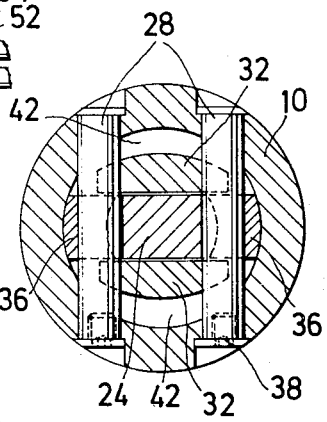
FIG. 3 is a transverse cross-sectional view across the section III—III shown in FIG. 2.
Figure 2:
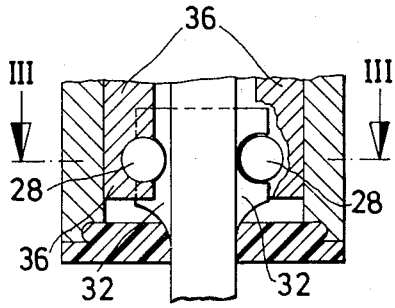
FIG. 2 is a sectional elevation of part of the rock-splitting apparatus, at an angle of 90° to the section shown in FIG. 1.
Figure 2:
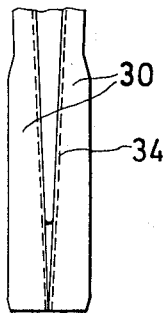
Figure 2:
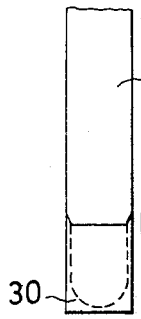

Whereas FIGS. 1 to 3 illustrate a particularly simple embodiment of the rock-splitting apparatus according to the invention, equipped with a thruster wedge, which is of course also suitable for the installation of a pull wedge, FIGS. 4 to 11 illustrate somewhat more refined and complicated embodiments of the invention; the rock-splitting apparatus shown in FIGS. 4 to 7 being provided with a thruster wedge and the rock-splitting apparatus shown in FIGS. 8 to 11 being provided with a pull wedge.

In each of the illustrated embodiments of the rock-splitting apparatus a tubular guide sleeve 12, 112, 212 is thrust into a casing 10, 110, 210, which is also tubular and is longer than the guide sleeve. At one end the casing 10 is closed off by a cylindrical cover 14, 114, 214, screwed into the casing 10, so that a piston 16, 116, 216 is longitudinally shiftable within a cylindrical chamber delimited between the cylinder cover 14 and the end face of the guide sleeve 12. In all the embodiments the piston is provided with piston rings 18, which simply have to be pushed into position on the piston, and with securing rings 20, which hold the piston rings 18 in position. A piston rod 17, 117, 217 is a structural unit with the piston, and is connected to the slider wedge 24, 124, 224 by way of a pin 26, 126, 226. A recess formed in the piston rod receives an end face of the slider wedge, and the pin is guided, transversely of the longitudinal direction, by the walls defining the recess and by the end of the slider wedge, by which the latter is secured to the piston rod.

Figures 4, 5, 6, 7:
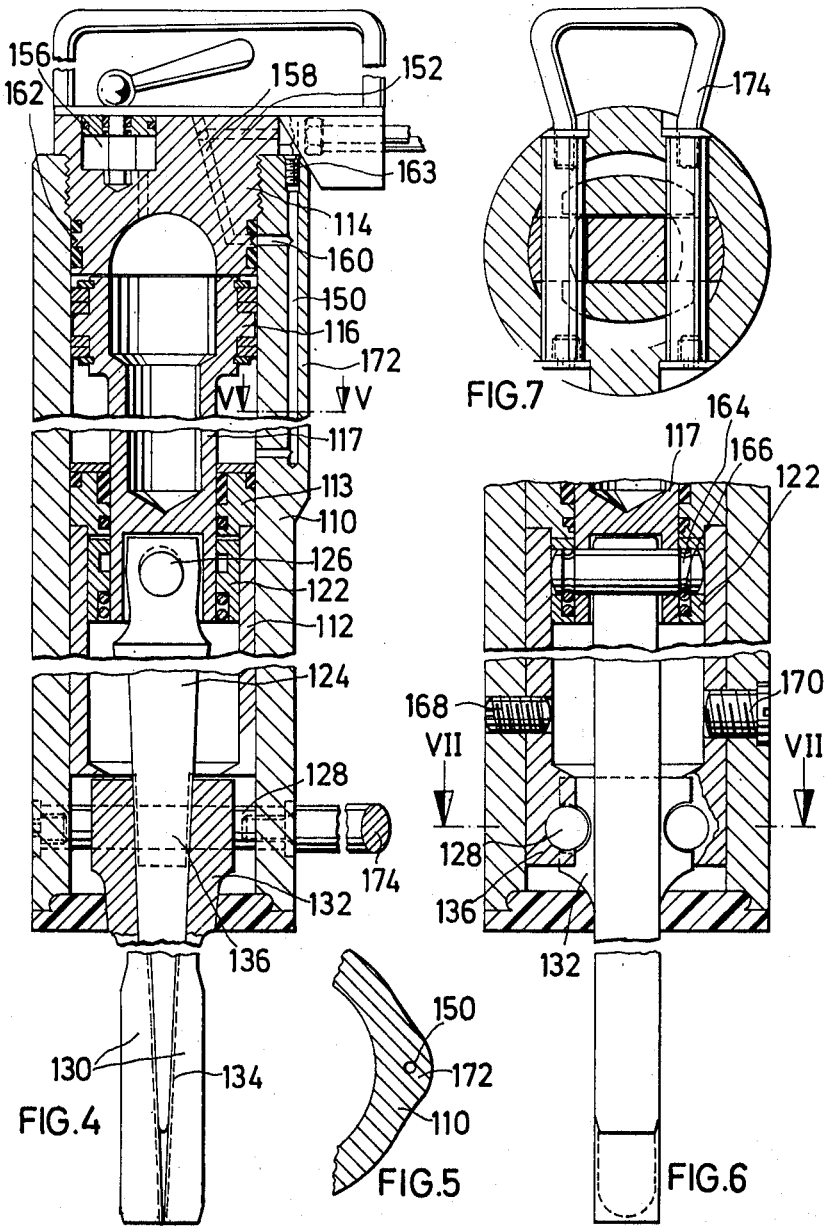
FIG. 4 is a sectional elevation, corresponding to that shown in FIG. 1, but of a somewhat more complicated form of rock-splitting apparatus.
FIG. 5 is a sectional view of part of the apparatus shown in FIG. 4 taken across the section V—V shown in FIG. 4.
FIG. 6 is a sectional elevation, corresponding to that shown in FIG. 2 of part of the apparatus shown in FIG. 4.
FIG. 7 is a transverse cross-sectional view across the section VII—VII shown in FIG. 6.
Figures 8, 9, 10, 11:
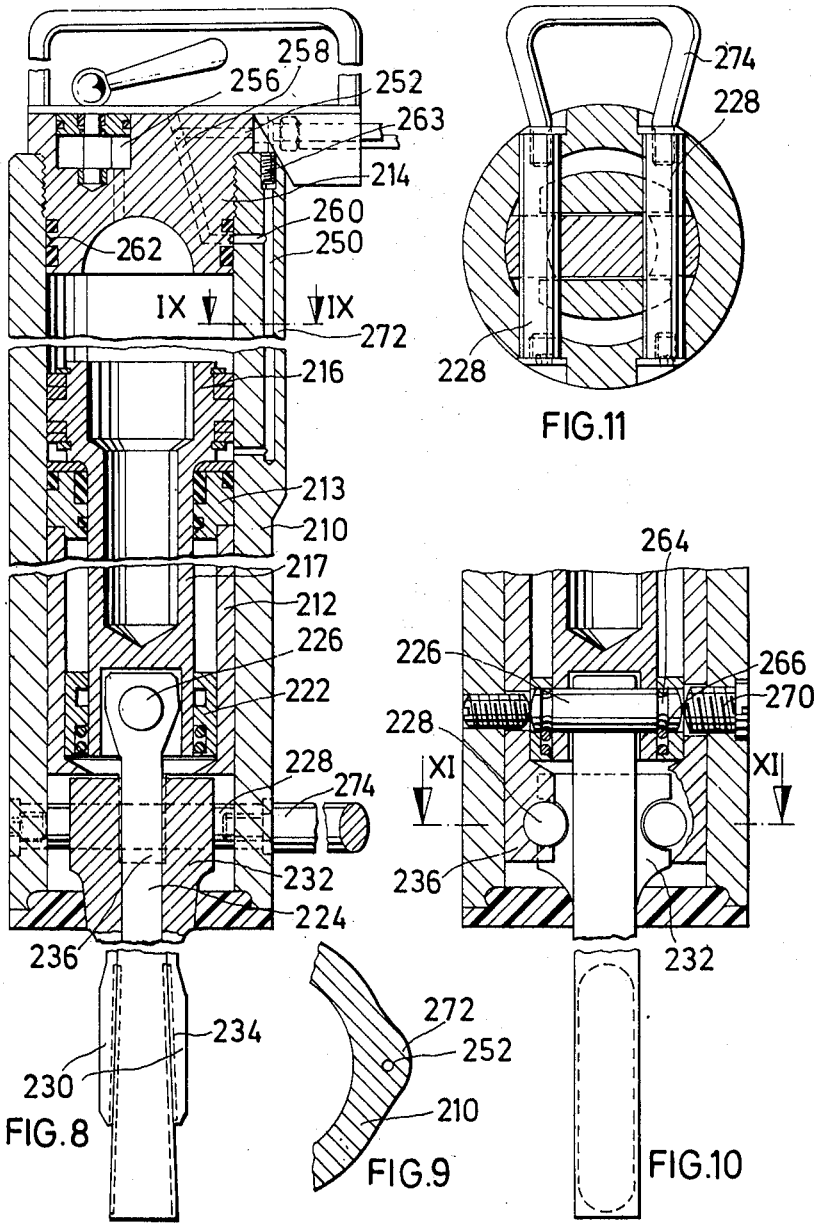
FIG. 8 is a sectional elevation, corresponding to those shown in FIGS. 1 and 4, of a rock-splitting apparatus equipped with a pull wedge.
FIG. 9 is a sectional elevation of part of the apparatus shown in FIG. 8, corresponding to that shown in FIG. 5, taken across the section IX—IX shown in FIG. 8.
FIG. 10 is a sectional elevation, corresponding to those shown in FIGS. 2 and 6, of part of the apparatus shown in FIG. 8.
FIG. 11 is a transverse corss-sectional view across the section XI—XI shown in FIG. 10.

The slider wedge engages in two mutually opposite-lying presser cheeks 30, 130, 230, whose heads 32, 132, 232 are suspended on transverse pins 28, 128, 228 so as to be laterally displaceable and immobilised in their longitudinal direction. With this in view, two transverse pins are guided, through the casing, and extend parallel to one another and at the same radial distance from the centre axis, these transverse pins being located outside the area proper occupied by the guide sleeve, so that the heads of the presser cheeks and the slider wedge lie between the transverse pins. In this embodiment the transverse pins are of circular cross-section, although this is by no means mandatory, the heads of the presser cheeks at least partially engaging round the transverse pins from the inside by way of complementary recesses, which in the first embodiment are of arcuate shape. In this way the position of the presser cheek is longitudinally fixed, although, as shown in FIGS. 1, 4 and 8, the presser cheeks can necessarily move to some extent laterally along the transverse pins.

In all the embodiments illustrated the regions at which the presser cheeks and/or slider wedges engage one another are provided with hard-metal facings 34, as shown in FIG. 1, so as to increase the useful working life of these components. Also, the transverse pins are always susceptible of being firmly attached to the casing, this attachment being effected at least on one side of the transverse pins and by means of screws 38, (FIG. 1); this ensures that the continuous vibration will be unable to loosen the transverse pins and thus cause them to fall out, which could have adverse effects. Furthermore, in all embodiments the lower end of the casing is closed off, in the region of the presser cheeks, by a resilient rubber plug or closure member 40, which surrounds the presser cheeks, seals off the inner space of the equipment to a large measure, and allows lateral movement — that is to say a movement apart from one another — of the presser cheeks. As shown in FIG. 1, the heads of the presser cheeks move in an inner space or chamber 42.

At its lower end each guide sleeve 12, 112, 212 has, in the vicinity of the heads of the presser cheeks, two diametrically opposite-lying guide strips 36, 136, 236, which at least partially surround from the outside the transverse pins, and constitute axial extensions of the guide sleeve between the heads of the presser cheeks. Due to the fact that they surround the transverse pins, these guide strips fix the position of the guide sleeve in both longitudinal and circumferential directions. When the transverse pins are circular, they also engage in complementary (i.e. circular) recesses in the guide strips 36, 136, 236. As the guide strips lie at positions turned through 90° relative to the path of lateral displacement of the heads of the presser cheeks, these guide strips do not disturb the movements which have to be carried out for splitting up rock.

In all the examples the guide sleeve 12 (FIG. 1) or a separate guide sleeve part 113, 213 (FIGS. 4 and 8) are provided with inner and outer sealing elements 46, which abut both against the casing and against the piston rod, and are equipped with an inner dirt catcher (or dirt wiper) 48, which prevents particles of dirt, introduced by the slider wedge, from entering the space within the cylinder. Further, each cylinder cover 14, 114, 214 is sealed off by a sealing element 44 (FIG. 1).

For the purpose of causing the piston to be advanced or retracted (together with the slider wedge, which is attached to it), the pressurised oil can be introduced into, and expelled from, the upper and lower faces of the cylinder, this movement of the oil taking place by way of inlet and outlet ducts 50, 150, 250, and 52, 152, 252. While ducts 52, 152, 252 are guided through the cylinder cover 14, 114, 214, duct 50 (FIG. 1) is, in a particularly simple manner, positioned outside the casing 10, and is only guided through the casing 10 in the region of the lower face of the cylinder, whereas ducts 150, 250 (FIGS. 4 and 8) are formed in the casing 110, 210 in the region of a widened portion 172, 272. For this purpose a blind bore passes longitudinally through the casing and opens out into the cylinder chamber and also, by way of a transverse bore 160, 260, communicates with an outer, annular groove 162, 262 of the cylindrical cover 114, 214. This annular groove 162, 262 also communicates with a diagrammatically represented duct 158, 258, formed in the cover.

As shown in FIGS. 4 and 8, a control valve 156, 256, in the form of a four-way walve, is located in the cover 114, 214 and, by way of a duct which is not shown, enables the flow of oil to and from the upper and lower faces of the cylinder to be controlled as desired. In this way it is possible to change over, with a single handle on the rock-splitting apparatus, from forward to reverse operation of the slider wedge.

In order to enable the longitudinal duct 150, 250, located within the casing 110, 210, to be formed more simply this longitudinal duct is drilled away from the end face of the casing, the opening or mouth thus formed at the end face of the casing being closed off by a sealing element 163, 263.

In the case of the somewhat more complicated embodiments shown in FIGS. 4 to 11 the transverse pins 128, 228 are attached to one another at the ends lying remote from the screws 38 (FIG. 1) by means of a U-shaped pin 174, 274, serving as a handle. This pin 174, 274 enables the transverse pins to be simultaneously pulled out introduced, and also enables — in conjunction with a handle 54 (FIG. 1), connected to the cylinder cover 14, 114, 214 — the rock-splitting apparatus to be manipulated in a more satisfactory manner.

Whereas the piston rod 17 shown in FIG. 1 is guided directly in the guide sleeve 12, in the case of the embodiments shown in FIGS. 4 and 8 the piston rod 17 is indirectly guided by way of a guide ring 122, 222 respectively, this guide ring being thrust into position over the piston rod 117, 217 and secured in this position, and guided along the guide sleeve. The pin 126, 226 at the same time serves to axially locate the guide ring 122, 222, by virtue of the fact that one or more locking springs 166, 266 (for example helical springs) engage, from the guide ring 122, 222, into annular grooves 164, 264 formed at the ends of the pin, and thus locate the latter. The springs lie in an inner recess formed in the guide ring which cooperates with the surface of the piston rod to define a groove open upwardly to the annular groove in the pin. The pin 126, 226 can in this way be easily introduced, thereby attaching together the parts which are intended to be connected, can be locked in this position, and can be once again released through knocking it out sideways. For this purpose the casing 110, 210 is provided with diametrically opposite-lying, radially aligned screw-threaded closure members 168, 268 and 170, 270 respectively. One of these screwthreaded closure members 170, 270 has a larger diameter than the pin 126, 226, so that the latter can easily be inwardly thrust and withdrawn when the screw-threaded closure member has been removed. This can take place easily and quickly when the piston rod has assumed the axial position shown in FIG. 10. The thinner opening enables the pin to be pushed out, through the larger opening, by means of an elongate object, so as to release from one another those parts which have been attached to one another, i.e. the slider wedge, the piston rod, and the guide ring.

The versatile rock-splitting apparatus, which can be used both as a thruster wedge equipment or as a pull wedge equipment, can (as shown in FIGS. 1 to 3) be embodied in a very simple form of construction and (as shown in FIGS. 4 to 11) also in a more complicated form of construction. For example, the more complicated form of construction enables the apparatus to be directly controlled, the oil ducts to be relocated, and the piston rod to be indirectly guided, which prevents disturbances caused by the presence of dirt, whereby the useful working life of the apparatus can be lengthened. Naturally, other parts are necessary for this, which are not needed in all instances of practical application, so that the simpler and cheaper version illustrated in FIG. 1 can easily be used. However, it is a feature common to all the embodiments that the presser cheeks are suspended on the two parallel, transverse pins in a simple, effective and easily releasable manner; the transverse pins are not supported from the slider wedge, so that it is possible to use pull wedges and thruster wedges whose shape can be varied to a large extent according to particular requirements. Whereas each slider wedge is articulated at the end at which it is attached, through the intermediary of a circular pin — thus ensuring that an asymmetrical lateral outward movement will not have adverse effects — the transverse pins may have circular, square, triangular or similar cross-sectional shapes. Thus, all individual parts of the rock-splitting apparatus can be of simple and inexpensive construction, and can be combined to form a commensurately inexpensive overall apparatus.

What I claim is:

1. Rock-splitting apparatus comprising a hydraulic piston-cylinder assembly in which a piston is reciprocable in a cylinder of uniform annular cross-section, between a cylinderical cover member at one end of the cylinder and one end of a sleeve of uniform annular cross-section disposed co-axially within the cylinder so as to engage the interior of the cylinder in oil-tight manner, a rod connected to the piston and mounted for movement along the sleeve, sealing means for sealing the space between the piston and the sleeve, a tapered slider wedge connected the piston rod, two presser cheeks mounted on opposite sides of the slider wedge for insertion into drill holes and having sliding surfaces which are sloped so as to be complementary to the tapered surfaces of the slider wedge and two transverse pins mounted in the cylinder and respectively engaging in transverse grooves formed in opposite sides of a head provided on each presser cheek to suspend the presser cheeks so that they are locked against axial movement relative to the cylinder, but capable of limited transverse movement.

2. Apparatus according to claim 1, in which the two transverse pins lock the sleeve against axial and rotary movements relative to the cylinder.

3. Apparatus according to claim 2, in which the two transverse pins respectively engage in transverse grooves formed in axial extensions of the sleeve.

4. Apparatus according to claim 3, in which the axial extensions of the sleeve are disposed between the heads of the presser cheeks.

5. Apparatus according to claim 1, in which the transverse pins are secured to the cylinder by means of screws.

6. Apparatus according to claim 5, in which the screws engage the ends of the transverse pins which are disposed on one side of the cylinder and the opposite ends of the transverse pins are connected by a U-shaped member.

7. Apparatus according to claim 1, in which ducts extending to spaces enclosed by the cylinder, on opposite sides of the piston, are formed respectively in the cover member and in a pipe which has a longitudinally extending portion and a transverse portion which passes radially through the cylinder.

8. Apparatus according to claim 7, in which a valve is provided in the cover member for controlling flow through the duct.

9. Apparatus according to claim 1, in which ducts extending to spaces enclosed by the cylinder, on opposite sides of the piston, are formed respectively in the cover member and in a longitudinally extending portion of the cylinder.

10. Apparatus according to claim 1, in which an annular-section skirt projecting from one end of the piston rod encloses the adjacent end of the slider wedge and is attached to the slider wedge by means of a connecting pin seated in transverse aperatures formed in the skirt of the piston rod and in the slider wedge.

11. Apparatus according to claim 10, in which the connecting pin extends perpendicularly to the transverse pins suspending the presser cheeks from the piston-cylinder assembly so as to permit limited pivotal movement of the slider wedge about the connecting pin.

12. Apparatus according to claim 10, in which the sealing means for sealing the space between the piston and the sleeve comprise sealing rings which are mounted in the radially inner and outer edges of a first annular collar disposed between the piston and the sleeve so as to provide the sleeve with an inwardly directed flange, and in which the piston rod is guided by a second annular collar mounted within the sleeve.

13. Apparatus according to claim 12 wherein the internal surface of said second annular collar engaged by said piston rod has a wiping element.

14. Apparatus according to claim 12, in which the second annular collar is attached to the piston rod for sliding engagement with the internal surface of the sleeve.

15. Apparatus according to claim 12, in which the connecting pin is also seated in transverse apertures formed in the second annular collar attached to the piston rod.

16. Apparatus according to claim 14, in which circumferential grooves are formed in opposite ends of the connecting pin for releasable engagement with diametrically opposite sides of a helical compressions spring disposed in an annular section recess formed in the second annular collar.

17. Apparatus according to claim 10, in which the cylinder and the sleeve are formed with diametrically extending apertures for alignment with the connecting pin, and in which screw-threaded closure members engage with screw-threads formed in the apertures in the cylinder, the apertures formed in at least one side of the cylinder and in the same side of the sleeve being greater in diameter than the connecting pin.

18. Apparatus according to claim 1, in which the sliding surfaces of the presser cheeks and the tapered surfaces of the slider wedge are provided with layers of wear resistant metal.

19. Apparatus according to claim 1, in which the piston is formed integrally with the piston rod, provided with at least one piston ring which is axially slidable along a cylindrical surface into engagement with an axial abutment, and fitted with a retaining ring for holding the piston ring in place against the axial autment.

20. Apparatus according to claim 1, in which a central cavity is formed in the piston and piston rod and extends from the end of the piston closer to the cylindrical cover member.

21. Apparatus according to claim 1 wherein the internal surface of the sleeve engaged by said piston rod has a wiping element.

* * * * *